US005142258A

United States Patent [19]

Gritti

[11] Patent Number: 5,142,258

[45] Date of Patent: Aug. 25, 1992

[54] DIRECT CURRENT RELAY ESPECIALLY FOR RAILWAY TYPE SIGNALLING SYSTEMS

[75] Inventor: Giovanni Gritti, Bologna, Italy

[73] Assignee: Sasib S.p.A., Bologna, Italy

[21] Appl. No.: 625,456

[22] Filed: Dec. 11, 1990

[30] Foreign Application Priority Data

Feb. 21, 1990 [IT] Italy ..... 12425 A/90

[51] Int. Cl.[5] ..... H01H 67/02

[52] U.S. Cl. ..... 335/128; 335/78

[58] Field of Search ..... 335/78-95, 335/124, 128, 202

[56] References Cited

U.S. PATENT DOCUMENTS

| | | | |
|---|---|---|---|
| 3,431,521 | 3/1969 | Kusano | 335/80 |
| 3,618,136 | 11/1971 | Fujita | 335/202 |
| 4,199,740 | 4/1980 | Woods | 335/202 |
| 4,309,682 | 1/1982 | Arnoux et al. | 335/128 |
| 4,625,194 | 11/1986 | Held | 335/271 |

*Primary Examiner*—Leo P. Picard
*Assistant Examiner*—Lincoln Donovan
*Attorney, Agent, or Firm*—Larson and Taylor

[57] ABSTRACT

A direct current relay is disclosed, which is especially fit for railway type signalling systems. The said relay comprises a core (7) extending horizontally through a coil (8), an iron yoke (6) disposed above the core (7), and fixed to the core fore end, and extending along the coil (8) to the core rear end, an armature (11) pivotally mounted at the free end of yoke (6), in front of the corresponding rear end of core (7), and sets of moving and stationary contact members (C1, C2, C3, C4, C5) carried by moving and stationary, elastically flexible strips (24) which project in superposed and reciprocally spaced relationship from a contact carrier block fixed on the yoke (6). The free ends of the moving strips (24) are engaged with a vertically movable contact operator template (17) operatively connected with the armature (11) for movement of the moving strips, to cause the moving contact members (C1, C2) to be moved into or out of electrical contact with the stationary contact members (C3, C4, C5) when the relay is energized. The moving and stationary contact members are situated above the fore end of the yoke (6). Two counterweights (16) respectively arranged on either side of coil (8) are provided, which are operatively connected with the armature (11) for moving the same into rest position when the relay is de-energized.

11 Claims, 5 Drawing Sheets

DIRECT CURRENT RELAY ESPECIALLY FOR RAILWAY TYPE SIGNALLING SYSTEMS

SUMMARY OF THE INVENTION

The invention relates to a direct current relay which is especially fit for railway type signalling systems, and comprises a core extending horizontally through a coil, an iron yoke disposed above the core and fixed to the one end (fore end) of the core, the said yoke extending along the coil to the opposite end (rear end) of the core, an armature pivotally mounted at the free end of the yoke, in front of the corresponding rear end of the core, and sets of moving and stationary contact members carried by moving and stationary, elastically flexible strips which project in superposed and reciprocally spaced relationship from a contact carrier block fixed on the yoke, the free ends of the moving strips being engaged with a vertically movable contact operator template operatively connected with the armature for movement of the moving strips, to cause the moving contact members to be moved into or out of electrical contact with the stationary contact members when the relay is energized.

The invention aims to provide a relay of the type as disclosed at the outset, which has a reduced depth dimension, combined with a very good possibility of visually inspecting the contact members, and with a simplification of the magnetic circuit. The object of the invention furthermore is to simplify also the contact members unit, while ensuring a strengthening of the same. A further object of the invention resides in improving the ID/IE de-energizing ratio so as to make the same higher than 0,6, and in improving the anchorage of the coil terminals to the sectioning taps by means of plug-in sectioning contact members.

The invention attains these objects by the provision of a relay of the type as disclosed at the outset, characterized by the combination of the following features:

a) two counterweights are provided, which are operatively connected with the armature for moving the same into rest position when the relay is de-energized, b) the moving and stationary contact members are situated in the area above the fore end of the yoke, c) the said counterweights are respectively arranged on either side of the coil, in such a position that does not impede the visibility of the contact members.

According to a further feature of the invention, the relay is formed by three pre-made and preset parts which are connected together at the time the relay is assembled, and which respectively consist in a die-cast body of the relay, in a magnetic circuit unit with a plate for the sectioning front sockets and in a contact members unit.

The said relay components are then covered with a preferably self-extinguishing, transparent plastics material casing, with its front end side being so made as to be rearwardly inclined in its upper portion which is associated with the contact members unit.

The handle element is formed directly on the casing front end side, and is situated at the rearwardly inclined upper portion of the casing front end side.

Advantageously, the front end side of the handle element handle part does not protrude beyond the front plane delimiting the maximum overall dimensions of the relay, and the said plane is defined by the front end surfaces of sectioning plugs associated with the sectioning sockets.

Preferably, the upper contact members are fitted with contact pieces of carbon or, as an alternative, of a graphite and silver alloy.

Also other features further improving the above disclosed relay form the object of the invention, and are the subject of the dependent claims.

BRIEF DESCRIPTION OF THE DRAWINGS

The particular features of the invention, and the advantages arising therefrom will appear more in detail from the specification of one preferred embodiment thereof, which is shown by way of a non-limiting example in the accompanying drawings, in which.

DESCRIPTION OF THE PREFERRED EMBODIMENT

Figure 9:
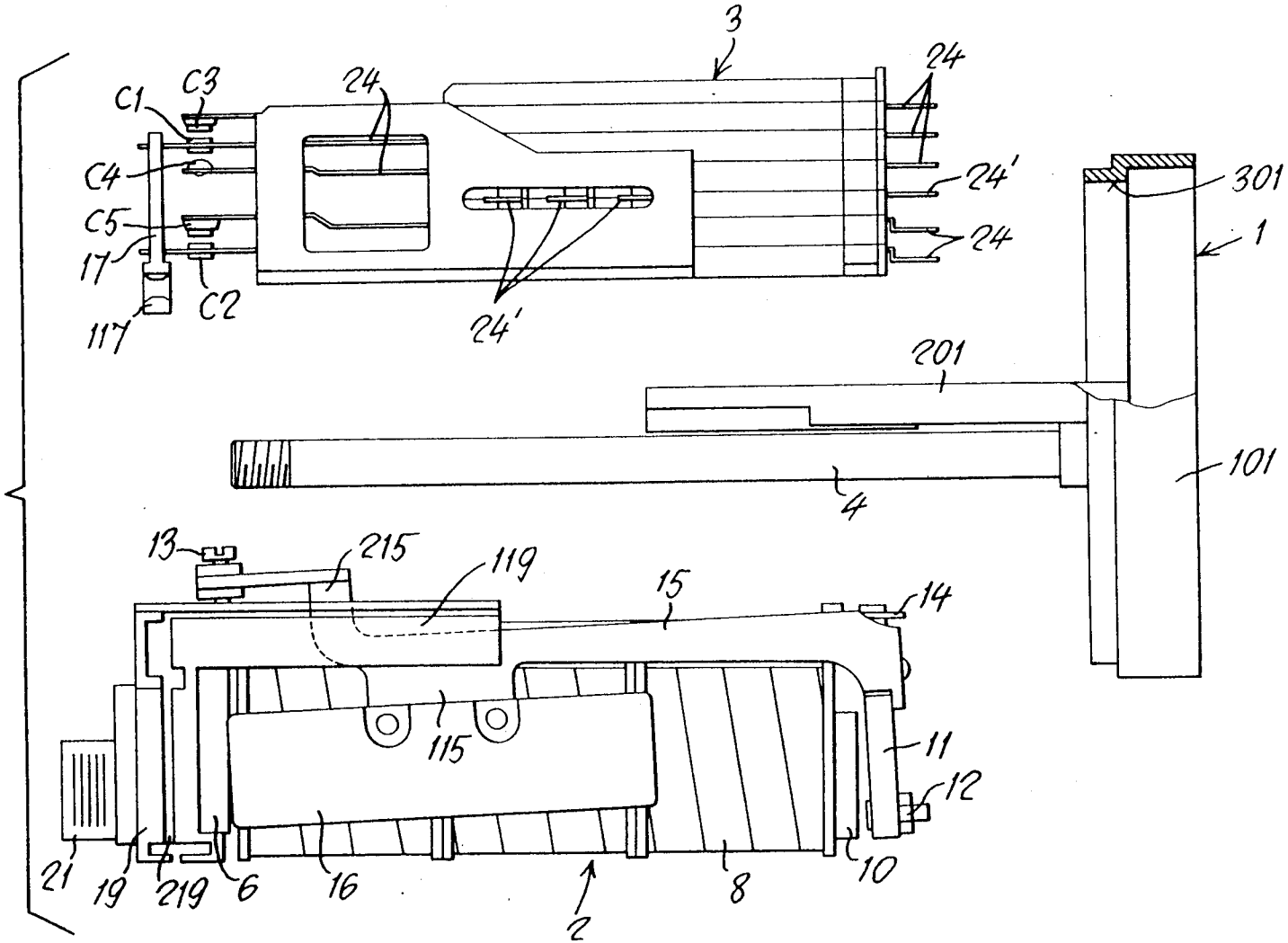
FIG. 9 is an exploded side view of the relay according to FIG. 1, showing its pre-made three parts in disassembled condition.

Referring to the Figures, there is shown that the relay according to the invention, substantially consists of three parts, i.e., a supporting body 1 made of a die-cast metallic material, on which the magnetic circuit unit 2 and the contact members unit 3 are fitted (see FIG. 9). The contact members unit 3 and the magnetic circuit unit 2 are in form of so pre-made pieces, that the same can be assembled in an extremely easy and accurate manner.

The supporting body 1 consists of a vertical plate 101 forming the rear end side of the relay, and which is to be connected with a not shown plug socket board to be fixedly fitted into a wiring board. The vertical plate 101 is provided in its median area with a horizontal wing-like support 201. Immediately under the horizontal wing-like support 201, two guide sleeves 4 are fixedly connected to the vertical plate 101, and are arranged in a parallel and horizontally coplanar relation, respectively at either side of the horizontal wing-like support 201. Each guide sleeve 4 extends up to the rear side of the vertical plate 101, and is caused to protrude from the front end side of the relay. The two guide sleeves 4 are to be fitted on two associated, sleeve-supporting pins (not shown), which are secured to the plug socket board fitted in the wiring board.

The magnetic circuit unit 2 is secured to the lower side of the horizontal wing-like support 201 by means of screws 5 threaded into an L-shaped platelet 6 which constitutes the iron yoke of the relay at the front end side of the core 7 of coil 8, and which is secured to the core front end side by means of screws 9. The opposite pole at the rear end side of the core 7 is provided with a pole piece 10 that by a certain air gap which is adjustable by means of screws 12, 13, is separated from the armature 11. The armature 11 is supported on the rear end of the yoke 6, so as to be swingable around a horizontal axis, which is transversal to the core 7. By means of two transverse upper grooves formed in the side edges of armature 11, the said armature is swingably engaged with the respective one of two wing-like supports 14. The wing-like supports 14 are fixed to the rear end of the yoke 6, and preferably consist of two opposite, laterally extending arms of a U-shaped platelet. By means of the two air gap-adjusting screws 12, 13 the width of the air gap in the energized and in the de-energized condition of the relay, is respectively established.

Particularly in FIGS. 5, 6, 8, and 9, there clearly appears that the armature 11 carries at both of its sides an arm 15 extending to the front region of the relay, and having a downward extension 115 to which a counterweight 16 is respectively attached. The counterweights 16 promote the torque for the armature 11 to be returned into rest position when the relay is de-energized, and always ensure a determinate stable position of the moving contact members, should the input current fail. These counterweights are each arranged on the respective side of coil 8, at the level of the same. Each arm 15 is provided at its fore end with an upward extension 215 which protrudes beyond the free fore ends of the contact members in unit 3, and which is engaged with a contact operator template 17 for shifting the moving contact members, which in the Figures are designated by references C1, C2. More particularly, each one of the two arms 15 is essentially formed by one-half of a frame substantially having a rectangular shape, with its rear end side being fastened to the armature 11, while the front end side thereof forms the upward extension 215, and is engaged with the contact operator template 17 for shifting the moving contact members C1, C2, which for this purpose is provided in the lower zone of each one of its side edges with a groove 117 for the said upward extension to be fitted therein.

Figure 1:
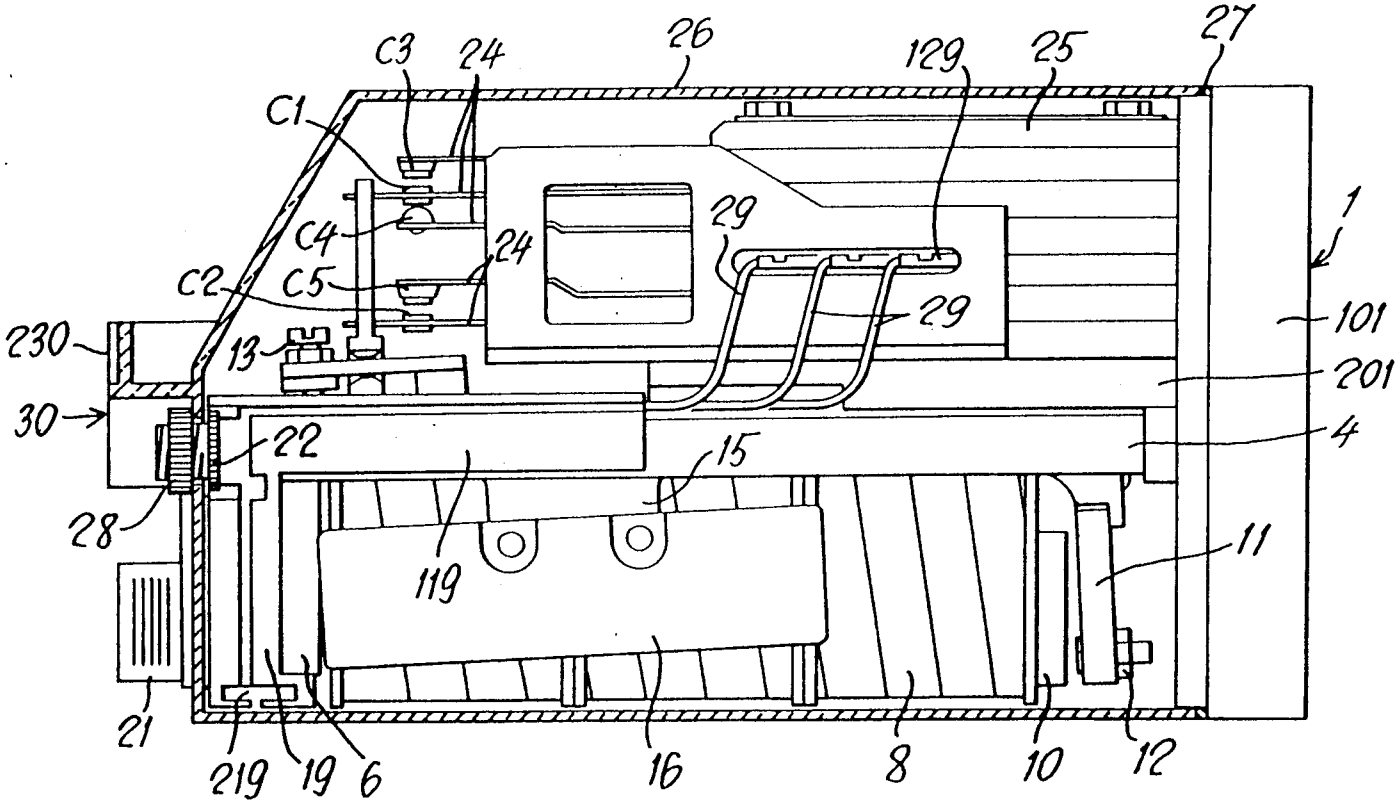
FIG. 1 is a side view of the relay according to the invention.
Figure 2:
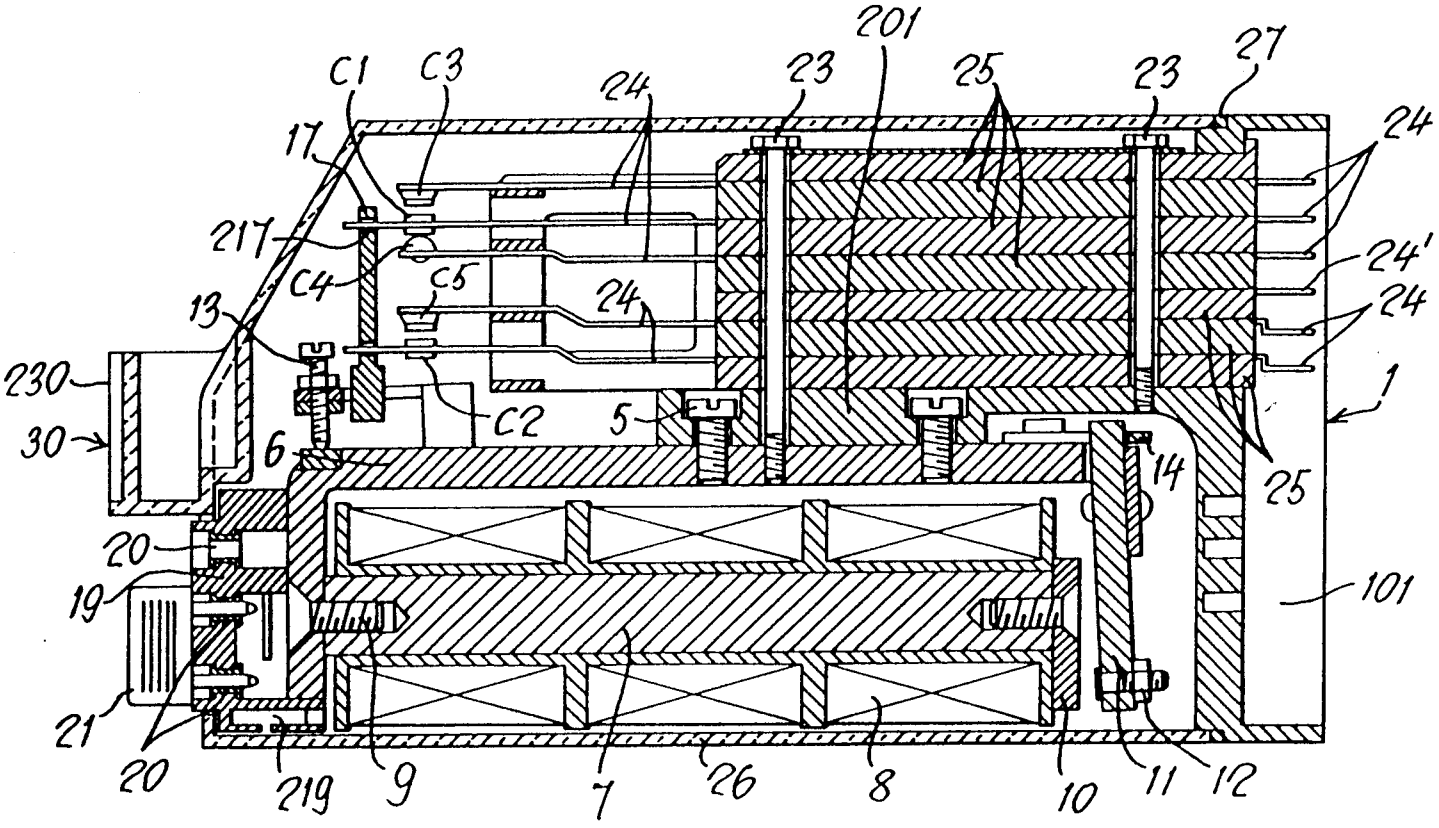
FIG. 2 is a view showing a vertical longitudinal section through the relay according to FIG. 1.
Figure 3:
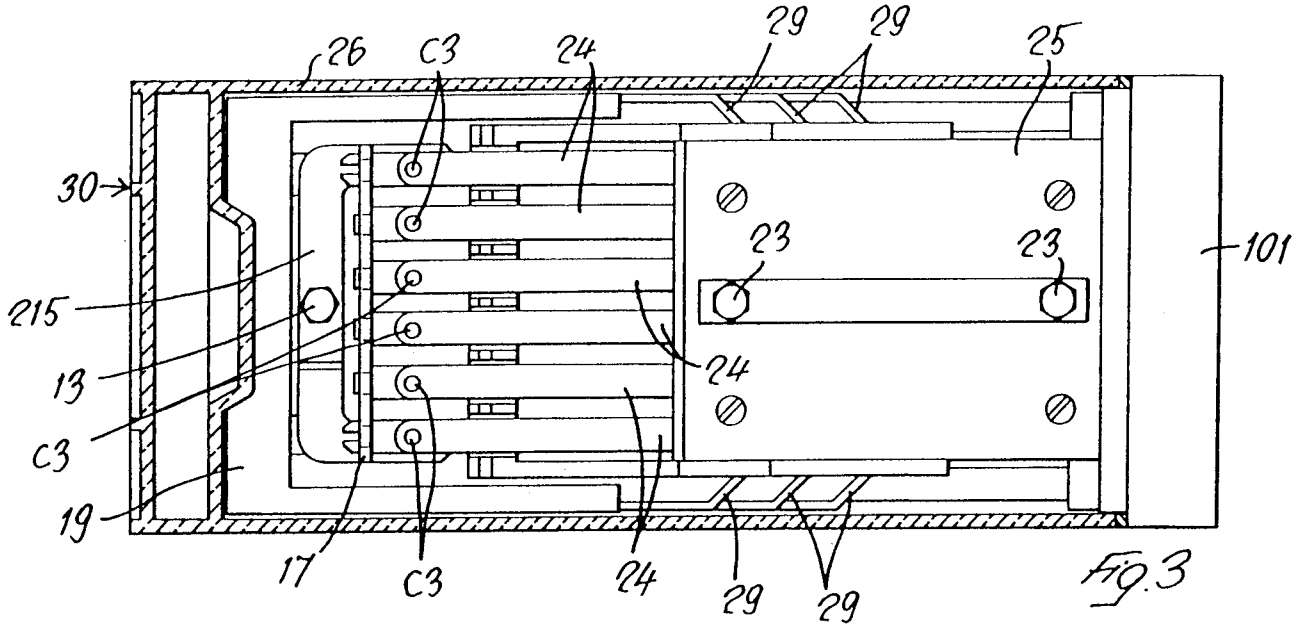
FIG. 3 is a top view of the relay according to FIG. 1.
Figure 8:
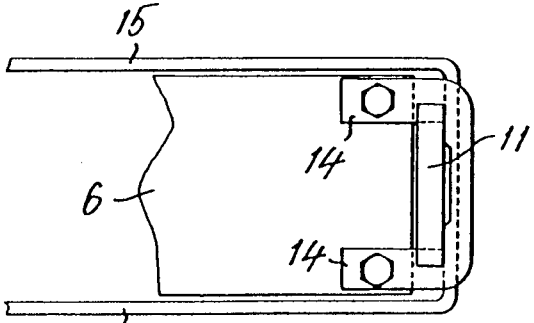
FIGS. 7 and 8 are views showing some details of the support for the armature of the relay according to FIG. 1.
Figure 7:
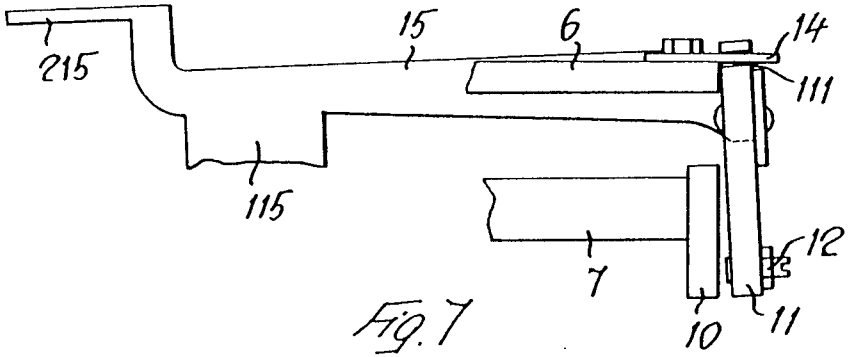
Figure 6:
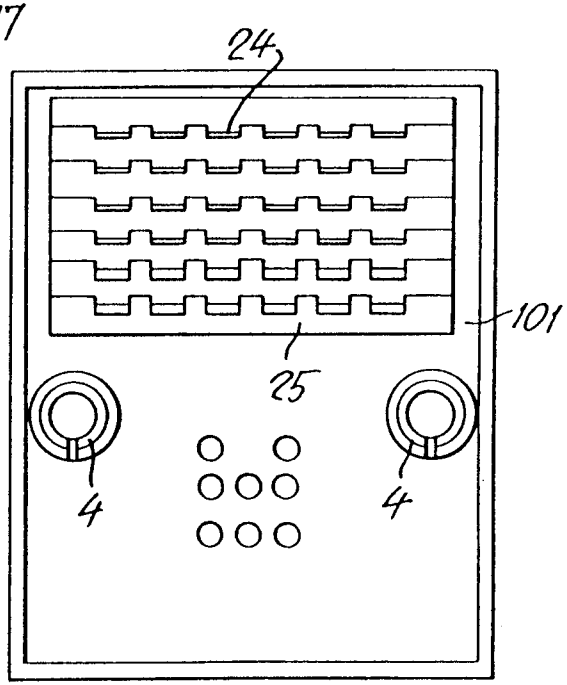
FIG. 6 is a view showing the front end side of the relay according to FIG. 1.
Figure 5:
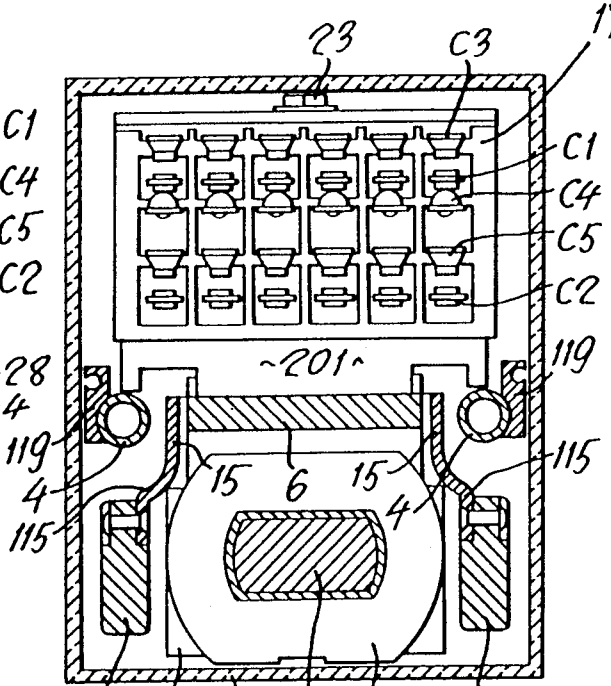
FIG. 5 is a cross-sectional view of the relay according to FIG. 1.
Figure 4:
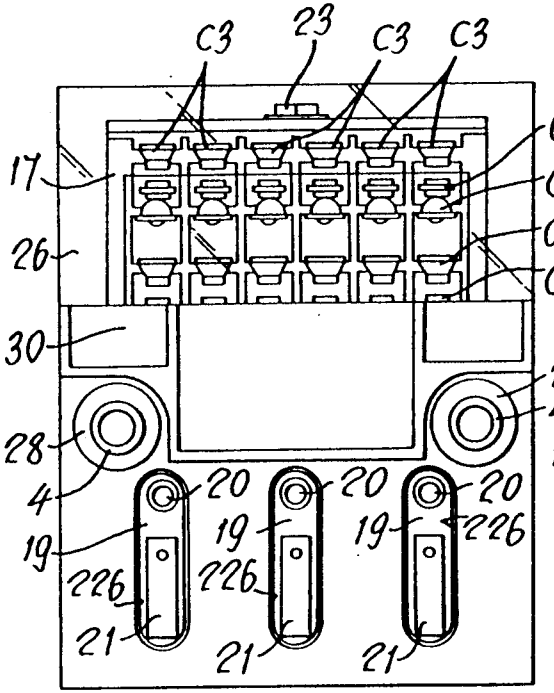
FIG. 4 is a view showing the front end side of the relay according to FIG. 1.

The coil 8 may be made in any suitable manner, and may, for example, consist of three separate coils sequentially arranged about the core 7. The coils 8 are wound on a reel 18 of insulating plastics material. In this case, the coil 8 is suitably divided into three successive coil sections. The coils 8 can be interconnected so as to achieve the required operative mode of the relay. At the front end side of the magnetic circuit unit 2, i.e., at the front end side of the yoke 6, the magnetic circuit unit 2 carries an insulating plastics material element 19 in which the conductors for feeding each coil 8 are each connected to sectioning sockets 20, whereby it is possible to have a metering made for testing the coils 8, and to have the coils 8 connected to each other in the desired manner by means of sectioning plugs 21. With the magnetic circuit unit 2 being in its assembled condition, the plastics material element 19 is clamped onto the free ends of the suitably threaded sleeves 4 by means of tab washers 22 (see FIG. 1), since this element is formed with matching holes. The said element 19 is also engaged on the sides of sleeves 4 by means of a respective lateral extension 119. The not shown conductors for feeding the coils 8 are passed into conductor-housing grooves 219, which are made in the external side edges of the plastics material element 19, and in its lateral extensions 119. Preferably, the conductors for feeding the coils 8 are anchored to the respective sockets 20 by means of plug-in contact members (not shown).

The contact members unit 3 comprises a contact carrier block which by means of screws 23 is secured to the upper side of the horizontal wing-like support 201 in the body 1 of the relay. The contact members unit 3 consists of elastically flexible conductive strips 24 arranged in more parallel planes. The strips 24 in each horizontal plane are set in an equispaced relation and are separated from the strips 24 in the adjacent plane by a suitably shaped insulating layer 25 of plastics material, preferably of polycarbonate. The conductive strips 24 which are all set in a vertically aligned relation, carry the moving contact members C1, C2 and the stationary contact members C3, C4, C5, and also form the conductors 24' for feeding the coils 8. The conductive strips 24 carrying the stationary contact members C3, C4, C5 and the conductive strips 24 carrying the associated, moving contact members C1, C2 extend to the front end side region of the relay. The conductive strips 24 carrying the stationary contact members C3, C4, C5, end at a short distance from the contact operator template 17, while the conductive strips 24 carrying the said moving contact members C1, C2, are engaged by means of axial extensions thereof, in an associated slot 217 provided in the contact operator template 17, so that as a result of said template 17 being vertically moved, the strips 24 carrying the moving contact members C1, C2, are bent toward the respective stationary contact members C3, C4, C5. The conductive strips 24' forming the conductors for feeding the coils 8, extend outwardly from the rear end side of the contact members unit 3, substantially in the median zone of said unit, and the flexible cables 29 for feeding the coils 8 are attached to the ends of the conductive strips 24' by means of plug-in connectors 129. The conductive strips 24, 24' have their rear ends projecting from the rear end side of the contact members unit 3, and through a respective opening 301 in the vertical plate 101 of the supporting body 1, the said strips rear ends are caused to stick out of the rear side of the said vertical plate 101, whereby plug-in contact members are thus formed in plate 101, for cooperation with contact clips in the not shown plug socket board. The contact operator template 17 associated with the moving contact members C1, C2, is made particularly of insulating, transparent plastics material, and as for what concerns the contact members C1–C5, which are situated in a forwardmost position in the area of the front end side of the relay, the said template 17 ensures a perfect visibility of the said contact members from the outside. This renders it possible to quickly and reliably make any required inspection of the relay.

According to a further feature of the invention, the contacts are made by means of pieces of a material having unweldability properties. More particularly, the upper stationary contact members C3, C5 are preferably fitted with contact pieces of carbon, or of a grapite and silver alloy.

The relay is enclosed, so as to be isolated from the exterior, in a preferably self-extinguishing, transparent plastics material casing 26. This casing is open at its rear end side, and with the interposition of an annular seal 27, the same is clamped against an adequate seating means in the vertical plate 101 of the supporting body 1. Two holes 126 are formed in the front end side of casing 26 for the guide sleeves 4 to be respectively passed through the said holes 126, and by means of tab washers 28 the said casing is fastened to the said sleeves. The front end side of casing 26 has a substantially vertical lower portion that extends for the most over the area in which the magnetic circuit unit 2 is located. The lower vertical portion of the front end side of casing 26 is provided with slots 226 coinciding with the sectioning sockets 20 in the magnetic circuit unit 2, and this vertical portion is caused to substantially bear against the plastics material element 19. Above the holes 126 for the guide sleeves 4 to be passed therethrough, the said vertical lower portion of the casing front end side is connected to an upper portion thereof, which is inclined toward the rear end of the relay. Apart from improving the contact members C1–C5 visibility conditions, the said inclined upper portion of the front end side of casing 26 allows a handle element 30 to be provided thereon, which projects from the front end surface of casing 26 by a very limited extent, particularly not beyond the maximum overall dimensions of the relay, as defined by the sectioning plugs 21, the handle part of the said handle element 30 being all the same graspable from its back side by the fingers of an operator's hand. In this embodiment, the handle element 30 is formed directly on the casing front end side, and its handle part 230 is in form of an upwardly turned vertical arm which extends at a short distance from the front end side of casing 26, near to the inclined portion of the said casing front end side.

The advantages of the relay according to the invention, clearly spring out from the above disclosure and from the drawings. Primarily, thanks to the devised, particular construction, a relay having a smaller width dimension, is provided. The particular arrangement of the counterweights 16 promoting the torque for the armature 11 to be returned into rest position when the relay is de-energized, allows to more rationally separate the magnetic circuit unit 2 from the contact members unit 3, and to situate the contact members in the front region of the relay, near to the front end side of the transparent casing, whereby the visibility of said contact members from the outside is thus improved. The above disclosed constructional features lastly permit to have the relay, according to the invention, formed by three pre-made and preset pieces that are quickly and simply connectable, with their relative positions being extremely precise and stable, and being such as to ensure uniform and constant characteristics.

I claim:

1. A direct current relay especially for railway type signalling systems, comprising a core (7) extending horizontally through a coil (8), an iron yoke (6) disposed above the core (7) and fixed to the one end (fore end) of core (7), the said yoke extending along the coil (8) to the opposite end (rear end) of core (7), an armature (11) pivotally mounted at the free end of yoke (6) in front of the corresponding rear end of core (7), and sets of moving and stationary contact members (C1, C2, C3, C4, C5) carried by moving and stationary, elastically flexible strips (24) which project in superposed and reciprocally spaced relationship from a contact carrier block fixed on the yoke (6), the free ends of the moving strips being engaged with a vertically movable contact operator template (17) operatively connected with the armature (11) for movement of the moving strips, to cause the moving contact members (C1, C2) to be moved into or out of electrical contact with the stationary contact members (C3, C4, C5) when the relay is energized, characterized by the combination of the following features:

a) two counterweights (16) are provided, which are operatively connected with the armature (11) for moving the same into rest position when the relay is de-energized, b) the moving and stationary contact members (C1–C5) are situated in the area above the fore end of the yoke (6), c) the said counterweights (16) are respectively arranged on either side of the coil (8), in such a position that does not impede the visibility of the contact members (C1–C5).

2. The relay according to claim 1, characterized in that the said relay is formed by three pre-made and preset parts which are connected together at the time the relay is assembled, and which respectively consist in a die-cast body (1) of the relay, in a magnetic circuit unit (2), and in a contact members unit (3).

3. The relay according to claim 1, characterized in that the magnetic circuit unit (2) is located in the lower zone of the relay, and is formed by the coil (8), the magnetic circuit (6, 7, 10, 11), and the insulating plastics material element (19) arranged in facing relation with the front end side of coil (8), and comprising the sectioning sockets (20) to which the conductors for feeding the coil (8) are connected, preferably by means of plug-in connectors, and the supporting body (1) consists of a vertical plate (101) to be connected with a plug socket board, which in turn is to be fitted into a wiring board, and of a horizontal wing-like support (201) for the said magnetic circuit unit (2) and for the contact members unit (3).

4. The relay according to claim 1, characterized in that the armature (11) is made in form of a rectangular frame, and each longitudinal half of said frame forms a supporting arm (15) having a downward extension (115) for the respective counterweight (16) to be attached thereto, and an upward extension (215) which extends into the upper zone of the relay, in front of the contact unit (3), with the contact operator template (17) being engaged with the said upward extension (215).

5. The relay according to claim 1, characterized in that the insulating plastics material element (19) fitted with the sectioning sockets (20) has two holes formed therein, and at each one of said holes the said element (19) is provided with an associated axial extension (119), by which the said element is engaged, when the relay is in assembled condition, with the respective one of two guide sleeves (14) which are integral with the die-cast suporting body (1).

6. The relay according to claim 1, characterized in that the supporting body (1) with the magnetic circuit unit (2), and the contact members unit (3) are enclosed, so as to be isolated from the exterior, in a preferably self-extinguishing, transparent plastics material casing (26), with its front end side being rearwardly inclined at its upper portion which is associated with the contact members unit (3), and being vertical at its lower portion which is associated with the magnetic circuit unit (2), the said front end side of casing (26) being formed in its lower vertical portion with holes (126) for the guide sleeves (4), and with slots (226) for the sectioning sockets (20).

7. The relay according to claim 1, characterized in that the handle element (30) is formed directly on the front end side of casing (26), and is situated on the rearwardly inclined upper portion of the front end side of casing (26).

8. The relay according to claim 1, characterized in that the handle element (30) has an upwardly extending, vertical handle forepart (230) which is near to the rearwardly inclined upper portion of the front end side of casing (26), and is situated at such a very short distance therefrom, as to allow the said handle forepart to be grasped by the fingers of an operator.

9. The relay according to claim 1, characterized in that the front end side of the handle forepart (230) of the handle element (30) does not protrude beyond the front plane delimiting the maximum overall dimensions of the relay, as defined particularly by the front end surfaces of the sectioning plugs (21) associated with the sectioning sockets (20).

10. The relay according to claim 1, characterized in that the upper contact members (C3, C5) in the contact members unit (3) are fitted with contact pieces of carbon or, as an alternative, of a graphite and silver alloy.

11. The relay according to claim 1, characterized in that the conductors for feeding the coil (8) are connected by means of plug-in connectors to the sectioning sockets (20) and to input contact members (24') provided in the contact members unit (3).

* * * * *